United States Patent [19]

Harris et al.

[11] Patent Number: 4,871,307

[45] Date of Patent: Oct. 3, 1989

[54] FLAME IGNITION AND MONITORING SYSTEM AND METHOD

[76] Inventors: George W. Harris, 301 Wilcrest #5310, Houston, Tex. 77042; John D. Echols, 32503 Pintail, Brookshire, Tex. 77423

[21] Appl. No.: 266,478

[22] Filed: Nov. 2, 1988

[51] Int. Cl.[4] ..... F23Q 23/00

[52] U.S. Cl. ..... 431/25; 340/579; 328/6

[58] Field of Search ..... 431/25, 1, 75; 340/579; 328/6

[56] References Cited

U.S. PATENT DOCUMENTS

| | | | |
|---|---|---|---|
| 3,504,992 | 4/1970 | Walbridge | 431/26 |
| 4,111,639 | 9/1978 | Matthews | 431/25 |
| 4,197,082 | 4/1980 | Matthews | 431/25 |
| 4,384,845 | 5/1983 | Hinton et al. | 431/26 |
| 4,413,303 | 11/1983 | Cheary et al. | 431/253 |
| 4,474,548 | 10/1984 | Miyanaka et al. | 431/25 X |
| 4,519,771 | 5/1985 | Six et al. | 431/25 |
| 4,672,324 | 6/1987 | van Kampen | 431/25 X |

*Primary Examiner*—Randall L. Green

*Attorney, Agent, or Firm*—Rodman & Rodman

[57] ABSTRACT

A system and method for igniting and monitoring a pilot flame for a burning of waste gas, such as the waste gas of an oil refinery or drilling rig, includes a current which is pulsed periodically with pulses of approximately one-second duration of electric power resulting in the outputting of an igniter electrode assembly of typically 6000 volts AC at 20 milliamperes at an alternating current frequency of typically 60 Hz. During the presence of a pilot flame, ionization of gas takes place resulting in a rectification of ignition current. The transformer has a monitoring winding outputting a signal from which a 60 Hz component is filtered out, the remaining signal having a sequence of pulses which varies between positive and negative intervals of the alternating current excitation. Comparison of the pulses provides for an indication of flame absence in the presence of equality of the pulses, and flame presence in the presence of an ineqality of the pulses. Pulse signals appearing in harmonics of the interaction in the flame plasma show spectral components in the range of 240 to 360 Hz.

20 Claims, 3 Drawing Sheets

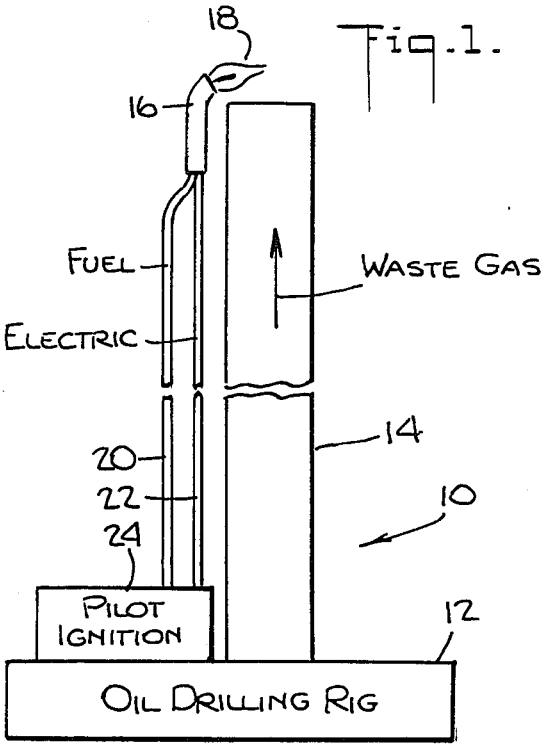
Fig. 1.
Fig. 3.
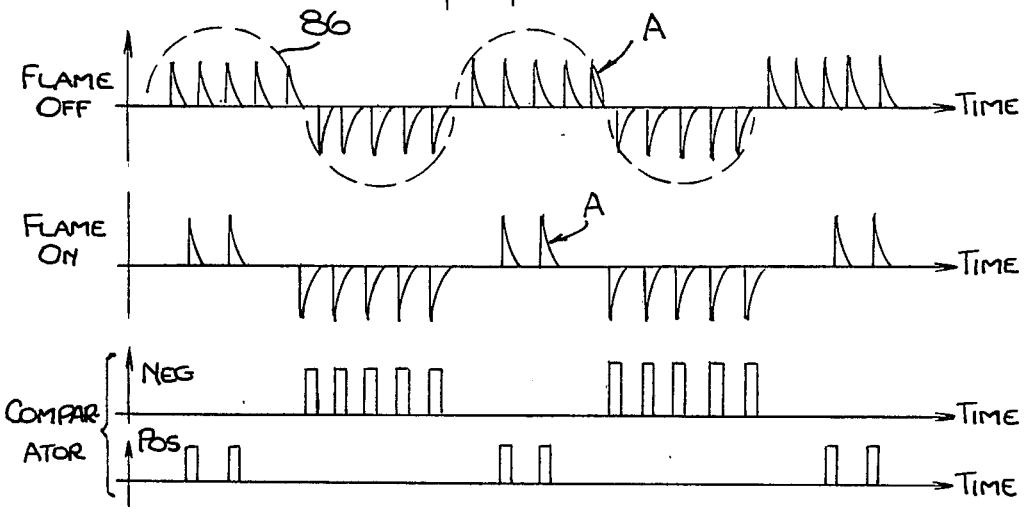

FLAME IGNITION AND MONITORING SYSTEM AND METHOD

BACKGROUND OF THE INVENTION

This invention relates to the burning of waste gas vented away from the site of a petroleum processing operation, including drilling and refining operational sites and, more particularly, to a remote electrical ignition and flame monitoring system and method for maintaining a flare for the burning of waste gas.

The term "waste gases" as used herein is intended to refer to gaseous substances generated during oil drilling and petroleum refining that are of insufficient value to warrant capture or collection. Waste gases include poisonous and explosive products such as hydrogen sulfide and propane, which cannot be permitted to freely escape into the air because of their hazardous and pollutionary nature.

A common method of disposing of waste gases is to burn the gases in the form of a flare as they are generated. The flare can be maintained continuously or produced intermittently depending upon the presence of the waste gases.

Waste gas flares are usually found at chemical plants, refineries, oil and gas well sites, compressor stations, offshore platforms and other locations wherein flammable materials may be discharged into the atmosphere as a by-product of some processing operation.

Due to the hazardous nature of many waste gases, the discharge point of the gases and the location of the flare is preferably at a safe, remote distance from personnel and equipment used in carrying out a drilling and refining process. Thus, waste gases are often discharged and burned at the end of vertical stacks which can rise more than 200 feet above the ground, or from the end of cantilevered venting structures on offshore drilling platforms which can extend approximately 180 feet above water.

Systems for providing waste gas flares at a waste gas disposal point are a vital part of a processing operation, and the failure to provide a flare when needed will usually lead to a total shutdown of a processing or production facility.

It is thus essential that a flare be provided when needed at a waste gas disposal site and that the presence of the flare be monitored when a burning operation is to be carried out. In some processing or refining operations, the discharge of waste gases can occur without warning and it is normal practice under these conditions to have a pilot flame burn continuously, to ignite the gases as they are vented.

A common problem in many known flame monitoring and ignition systems is their occasional failure to clearly indicate whether a pilot flame is present or absent. To offset this difficulty some operators intentionally vent an additional volume of gases through a stack to make a flare more apparent. However such practice can be dangerous to both personnel and equipment because it is difficult to measure the amount of raw gas accumulating in the stack before it reaches the flare point. Explosions can thus result.

One type of flame sensing device in present use includes a heat sensor. However heat sensing devices are subject to slow response, premature burnout due to extreme temperatures, and lightning damage. The reliability of heat sensing devices is thus questionable.

Another known flame sensing device detects the ionization of gas molecules resulting from a burning flame. The sensors used in this device are somewhat fragile and depend upon a separate source of electric current, as well as a separate conductor for operation.

Optical sensors have also been used to monitor the presence of a flare but require sensitive electronic systems that are subject to frequent failure in harsh operating environments.

In some instances, the discharge of waste gases occurs at predictable predetermined times and the ignition of such gases can be arranged to occur at such time as they are discharged.

Thus it is often desirable to have the capability of igniting a flare intermittently at a site remote from operating personnel and equipment.

One known way of igniting a flare on an as-needed basis is to use a flame-front system to ignite a pilot light which, in turn, ignites the waste gas flare. The flame-front system employs a mixture of air and gas which is purged along a pipe from the ground to the flare tip. A spark is then introduced into the pipe at the ground to ignite the gas-air mixture in the pipe. A resulting flame front of burning gases progresses along the pipe to the tip, and exits into the pilot body igniting the main gas supply.

The flame-front system is very sensitive to humidity, rain, piping orientation, and other characteristics of individual situations wherein the pipe is deployed. The flame-front system often requires numerous attempts to ignite a flame successfully and has occasionally been found to be unreliable.

When a flame-front system fails to ignite a pilot flame and the waste-gas flare, a backup procedure, such as the firing of a pyrotechnic flare from a rifle or pistol though the escaping gases may be employed. The use of pyrotechnic flares requires a skillful operator, and is seldom safe in the environment of a refinery or off-shore platform.

Known attempts to resolve the foregoing ignition problems include the use of electronic ignition systems employing a high voltage device such as a transformer to deliver a reliable spark at an igniter head. The term "high voltage" as used herein refers to voltages in excess of approximately several kilovolts. Other circuitry employed in known electronic ignition systems include relaxation oscillators or high voltage generators. Such electrical equipment, while capable of developing high voltage often cannot deliver adequate current for ignition.

Another problem in the use of electronic ignition has been the need for a long ignition cable to bring high voltage to the site of the flare. Such cables have been found to introduce substantial loss to electric signals transmitted along the cables. Consequently, some electronic units are located relatively close to an igniter electrode. Close proximity of an electronic unit to an igniter electrode subjects the electronic circuitry to tremendous amounts of heat which leads to premature failure. Furthermore, since the electronic circuitry is practically inaccessible, it is costly to repair.

A further problem of electronic ignitors is that they operate with high frequency signals, in excess of several kilohertz. Such high frequency signals are attenuated by the capacitance of an ignition cable. Thus, presently available ignition devices deploying ignition cables have a maximum operating distance limit, typically of 25 feet in optimum conditions.

It is thus desirable to provide a flame ignition and monitoring system which reliably monitors the existence of waste gas flare and which can be operated at periodic intervals to provide an ignition spark when needed.

SUMMARY OF THE INVENTION

In accordance with the present invention, the flame ignition and monitoring system employs an electrode assembly positioned at a fuel passage for providing alternating electric current at a relatively low frequency and at a relatively high voltage. The current is provided at a frequency in the range of 40 to 400 Hz, preferably 60 Hz, and the voltage is provided in the range of 4 to 20 kilovolts, preferably 10 kilovolts.

Power for generating the alternating current is provided by a step-up transformer with an input winding coupled via a gating circuit to a supply of low voltage, in the range of approximately 60 to 120 volts AC. A computer operates the gate, which may be a thyristor, for periodically applying power to the transformer.

For example, the power may be applied as a pulse having a duration of one second, and is reapplied repetitively once every 10 seconds. This arrangement provides for continuous reignition of waste gas in the event that a flame of waste gas is blown out by a strong wind.

In accordance with another feature of the invention, the transformer is provided with a further winding, serving as a monitoring winding, which provides an output current proportional to the current flowing through the electrode assembly. If the alternating current has a frequency of 60 Hz, the primary frequency component of current in the monitoring winding is also 60 Hz. By filtering out the primary component at 60 Hz, there remains in the monitoring current higher frequency components resulting from nonlinear interaction of the current with the transformer, the transmission cable, the electrode assembly and, particularly with ionized particles in the pilot flame, which ionized particles are known to introduce a rectifying action to the ignition current. The non-linear components, which include frequencies as high as six times that of the fundamental component, have the waveforms of voltage spikes.

With respect to the rectifying action of the ionized particles in the pilot flame, current which flows in the forward direction during the forward half-cycle of the alternating current tends to produce less of the foregoing spike waveforms than is produced by current flowing in the reverse direction during the reverse half-cycle of the alternating current. By counting the pulses occuring during the positive and the negative half-cycles of the alternating current, the difference in the rates of occurrence of the voltage spike waveforms is measured. In the absence of a pilot flame, the rates of occurrence of the spike waveforms will be approximately equal during the positive and the negative half cycles of current flow. However, during the presence of a pilot flame, the rates of occurrence of the spike waveforms is significantly different between the positive and the negative half cycles of current flow. This difference serves as an indication of the presence and absence of a pilot flame.

As a further feature of the invention, a relatively small amount of current, at least two orders of magnitude less than that required for ignition, is allowed to flow through the gate to the primary winding of the transformer to induce current flow through the flame. A current measuring meter is connected in circuit with the output winding of the transformer which feeds the electrode assembly, to measure the flame current. In the event of extinction of the flame, the meter registers zero current. A shunt switch bypasses the meter to protect the meter during the presence of an ignition current pulse. The current measuring meter provides a backup indication of the presence of a flame. To provide further backup indication, a phase locked loop may be applied to the filtered monitoring current to sense a frequency component thereof which is established to be present during the presence of the pilot flame. The actual frequency component has been found to depend on characteristics of the electrode assembly and the pilot housing and, accordingly, need be measured at system startup. The phase locked loop is then tuned to the pre-established value of frequency so as to provide an output logic signal indicating the presence of the flame.

The invention accordingly comprises the constructions and method hereinafter described, the scope of the invention being indicated in the claims.

DESCRIPTION OF THE DRAWINGS

In the accompanying drawings,

FIG. 1 is a simplified schematic view of an oil drilling rig and stack for waste-gas having a pilot ignition and monitoring system incorporating one embodiment of the present invention;

FIG. 3 shows simplified waveforms that illustrate the monitoring function of the invention.

Corresponding reference characters indicate corresponding parts throughout the several views of the drawings.

DETAILED DESCRIPTION OF THE INVENTION

Figure 2:
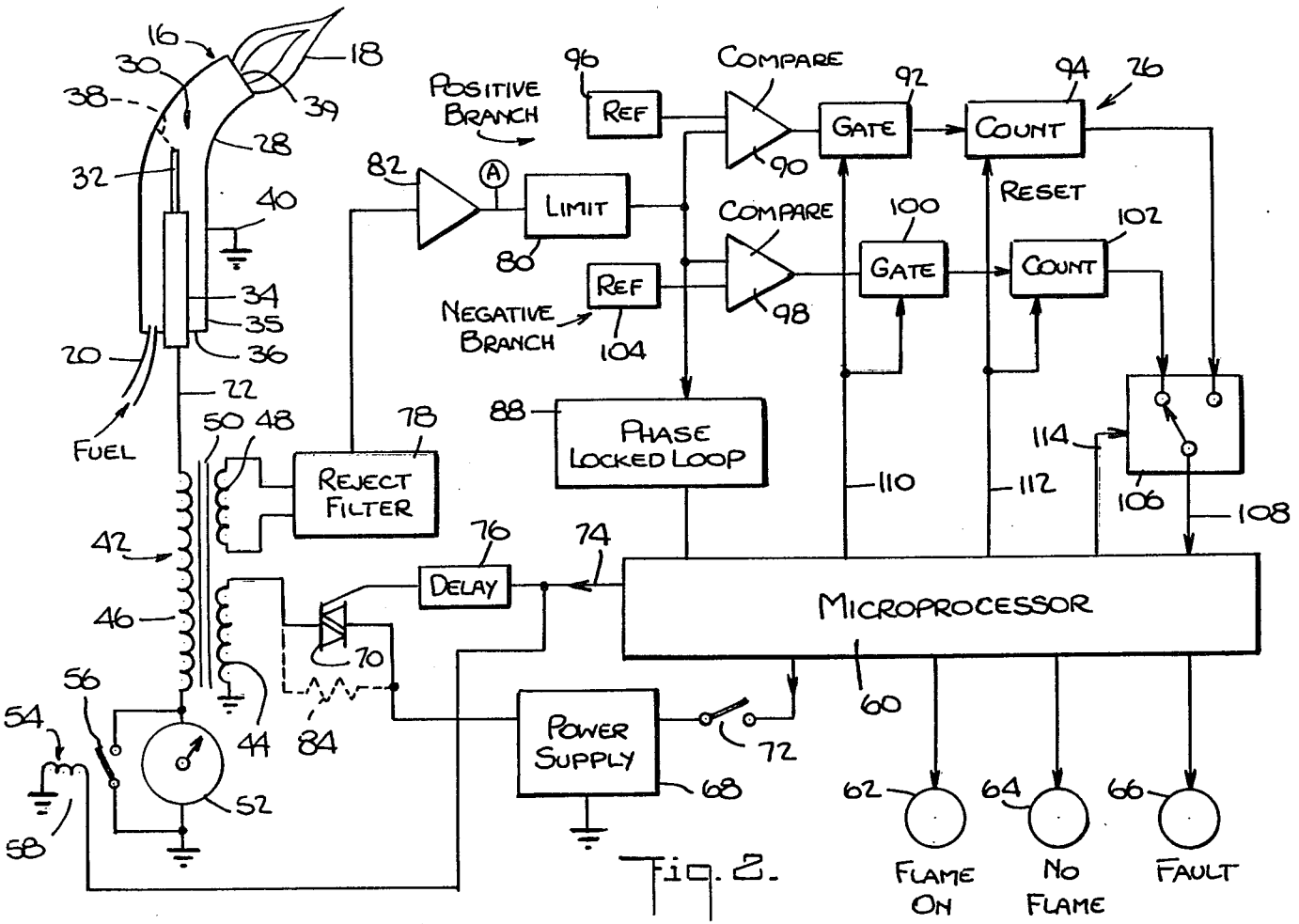
FIG. 2 is a block diagram of the ignition and monitoring system of the invention.

A drilling station for a petroleum processing plant incorporating one embodiment of the invention is generally indicated by the reference number 10. Reference number 10 can also designate a refinery or other apparatus for the processing of oil incorporating one embodiment of the invention.

The station 10 includes a platform 12 for supporting oil drilling equipment (not shown) and a stack 14 for the venting and disposal of waste gas. A derrick for holding sections of drill pipe which is supported by the platform 12 in a known manner, is not shown to simplify the drawing.

An ignitor 16 is disposed at the top of the stack 14 for directing a pilot flame 18 across an opening 15 of the stack 14 for igniting a waste-gas flare when waste gas is present. A fuel tube 20 conducts a fuel, such as methane, to the ignitor 16 to be burned as the pilot flame 18. An electrical conductor such as an ignition cable 22 conducts an ignition current to the ignitor 16 for electrical ignition of the pilot flame 18. The ignition current is produced within a pilot flame ignition and monitoring unit 24 disposed on the platform 12. The stack 14 extends upwardly from the platform 12 to a substantial height, such as 200 feet, and the tube 20 and the cable 22 extend upward a corresponding height from the ignition unit 24.

The function of the ignition unit 24 is to apply fuel through the tube 20 for maintenance of the flame 18, and to provide an ignition current through the cable 22 to the ignitor 16 for igniting the flame 18. In addition, the unit 24 monitors the flow of electrical current through the flame 18 to determine the presence of the flame 18, and to signal operating personnel of the station 10 in the event of loss of the flame 18. The generation of the ignition current, and the monitoring of the flame current is accomplished by electrical circuitry within the unit 24.

Referring to FIG. 2, the unit 24 includes an electrical circuit 26 for supplying ignition current to the ignitor 16, and for monitoring the flow of electric current within the flame 18. The ignitor 16 has a tubular snout 28 formed of electrically conductive metal that constitutes one electrode of an electrode assembly 30 of the ignitor 16. A second electrode of the electrode assembly 30 is formed as a post 32 held by an encircling insulator 34 in an interior portion of the snout 28. Conventional means (not shown) are provided for positioning the insulator 34 and the post 32 within the snout 28.

Gaseous fuel provided by the tube 20 enters a proximal end 35 of the snout 28 in conjunction with an inflow of air at a port 36 of the snout 28. The fuel and the air, which mix within the snout 28, are ignited by a spark 38 from the ignition current, and exit as the flame 18 from a distal end 39 of the snout 28. The post 32 connects through the insulator 34 with the ignition cable 22, and the snout 28 is electrically connected to the circuit 26 by means of a ground connection 40 which connection, for example, can be an outer conductor (not shown) of the ignition cable 22.

The circuit 26 provides the ignitor 16 with both monitoring and ignition functions by coupling a transformer 42 to the ignition cable 22. The transformer 42 comprises a primary winding 44, a secondary winding 46, and a monitoring winding 48 which are coupled magnetically by a core 50. One end of the secondary winding 46 connects with a central conductor of the cable 22, and the opposite end of the secondary winding is connected by a current-measuring meter 52 to ground.

A relay 54 having a switch contact 56 is connected in parallel across terminals of the meter 52 to provide a protective bypass across the meter 52 upon closure of the switch contact 56 to protect the meter 52 during ignition of the flame 18. The protective function is initiated by energizing a coil 58 of the relay 54 to close the contact 56, the meter 52 resuming normal operations upon a deenergization of the coil 58 for opening of the contact 56.

The circuit 26 comprises a microprocessor 60 and a set of lamps connected thereto, including a lamp 62 for indicating that the flame 18 is present, a lamp 64 for indicating an absence of the flame 18, and a lamp 66 to indicate a malfunction within the monitoring process of the circuit 26.

A power supply 68 is connected by a gating element such as a triac or thyristor 70 to the primary winding 44. The power supply 68 is activated by a signal applied to the supply 68 by the microprocessor 60 via a switch 72. The supply 68 provides an alternating current and an alternating voltage to the winding 44, the voltage being in a range of approximately 50 to 150 volts at a frequency in the range of approximately 40 to 400 Hz. A typical value of voltage is 120 volts, and a typical frequency is 60 Hz. Also included within the supply 68 is a supply of DC voltage (not shown) for operation of the microprocessor 60 and other components of the circuit 26.

A further output 74 connects with a terminal of the relay coil 58, and also connects via a delay unit 76 to a control terminal of the thyristor 70. A signal provided by the processor 60 at the output 74 places the thyristor 70 in a state of conduction for coupling power from the supply 68 to the transformer 42 for igniting the flame 18. By connecting both the relay coil 58 and the thyristor 70 to the same output of the microprocessor 60, the protective bypass across the meter 52 is activated concurrently with the application of power to the transformer 42. The delay unit 76 introduces a delay of approximately one-tenth of a second to ensure that the protective bypass is secure before the thyristor 70 is placed in the conductive state.

A band reject filter 78 is serially connected between the monitoring winding 48 and an amplitude limiter 80, an output terminal of the filter 78 being connected via an amplifier 82 to an input terminal of the limiter 80. In the construction of the reject filter 78 (FIG. 2), it is convenient to use a second order band reject filter comprising two operational amplifiers with resistor-capacitor feedback networks. A connection between the amplifier 82 and the limiter 80 is designated a terminal A to facilitate identification of the location of a signal to be described subsequently with reference to FIG. 3.

In operation of the circuit 26, all currents flowing through the secondary winding 46 to the electrode assembly 30 induce a proportional monitoring current in the winding 48, which current is supplied to an input port of the filter 78. The currents in the primary winding 46 include both ignition current and a flame current which is allowed to propagate through ionized gases of the flame 18 during intervals of time, to be referred to as interpulse intervals, between pulses of ignition current.

The microprocessor 60 periodically energizes the transformer 42 by applying a periodic train of pulses to the thyristor 70. For example, the duration of the turn-on pulse of the thyristor 70 is approximately one second, and the pulse repeats every 10 seconds. During the interpulse interval of approximately nine seconds, leakage current flows through the thyristor 70 from the supply 68 to the primary winding 44. Should the leakage current be insufficient, a resistor 84, shown in phantom, may be connected in parallel with the thyristor 70. The leakage current is an alternating current which is coupled via the core 50 to appear as a flame current that propagates through the ionized gases of the flame 18 during the interpulse intervals.

The supply 80 provides a predetermined amount of voltage, and the resultant current depends, in part, upon the nature of the electrically conductive path provided by the plasma of the flame 18. The waveform of the flame current resulting from the plasma action appears also on the monitoring current in the winding 48. Due to the 60 Hz excitation, a major component of the waveform in the monitoring current occurs at 60 Hz. The filter 78 rejects the component at 60 Hz so as to pass only harmonics of the excitation current, as well as other frequency components resulting from nonlinear interaction of current with plasma.

The fundamental component is substantially larger than the higher frequency components which contain information as to the nature of the flame 18, and tends to mask this information. By rejecting the fundamental component, the filter 78 allows the remaining portion of the monitoring signal to be processed for extraction of flame information. The transformer 42 is a step-up transformer having a step-up ratio of approximately 60:1 for stepping up an input voltage of 120 volts to an output voltage of approximately 7000 volts. The step-up ratio of the transformer 42 is sufficient to provide adequate voltage for ignition of the flame 18, as well as adequate voltage for maintaining flame current during the interpulse intervals.

With reference also to FIG. 3, it should be noted that the data bearing signals outputted by the filter 78 are of relatively low amplitude, and are amplified by approximately 20 dB (decibels) by the amplifier 82, prior to further amplification and limitation by the limiter 80. The waveform of the data bearing signals varies considerably as a function of the physical characteristics, such as shape and size, of the snout 28, and as a function of the electrical characteristics of the electrode assembly 30 and the ignition cable 22, as well as the geometry of the post 32 relative to the configuration of the snout 28.

A typical configuration of the waveform is shown in the first two graphs of FIG. 3. The first and second graphs of FIG. 3 show the waveforms at terminal A for the respective conditions wherein the flame is absent and wherein the flame is present. These waveforms have a sputtering pattern of a sharp rise time followed by an exponential decay. A noteworthy characteristic of the waveform is that, in the absence of the flame, the waveform is approximately symmetrical for both positive and negative directions of current flow during each cycle of the alternating current.

The cycles of alternating current are represented in phantom by a dashed line 86 in FIG. 3 as a reference to identify the periodic nature of the data bearing waveform. The number of individual pulses shown within each cycle is dependent on the physical and electrical characteristic of a particular installation of an igniter 16, the number of pulses shown in FIG. 3 being provided simply to indicate the nature of the waveform.

A further characteristic of the data bearing waveform, which is of great use in implementing the monitoring function of the invention is shown in the second graph wherein the effect of plasma becomes evident. Since the plasma has the tendency to polarize the electrode assembly 30, and introduce a rectification action to current flowing through the flame plasma, the voltage is substantially reduced in the forward direction of current flow through the flame. Consequently, substantially fewer voltage pulses are produced during the forward direction of current flow as indicated in the second graph.

The circuit 26 is constructed of a positive branch and a negative branch for counting the number of pulses produced in each branch over a predetermined measuring interval of time so as to note whether there is substantial equality of pulses, indicating flame absence, or substantial inequality of pulses, indicating flame presence.

The foregoing pulses at terminal A can be observed during the pulsing intervals when the thyristor 70 is in a state of conduction. However, during the interpulse intervals, when the current of the secondary winding 46 is substantially lower, it is not feasible to observe these pulses. Instead, if desired, a phased locked loop (PLL) 88 may be connected between an output terminal of the limiter 80 and an input terminal of the microprocessor 60.

The loop 88 is tuned to identify a frequency component which is characteristic of the monitoring current in the presence of the flame. Due to the high gain and narrow bandwidth of the loop 88, the loop 88 can lock onto the identifying frequency component produced by the flame plasma and the frequency of the excitation voltage of the supply 68. The loop 88 is thus operative during an interval of pulsing as well as during an interpulse interval so as to provide continuous information as to the status of the flame 18.

The loop 88 outputs a logic signal to the microprocessor 60 indicating the presence or absence of the flame. Also, the meter 52 is sufficiently sensitive to provide an indication of the current in the secondary winding 46 during the interpulse intervals. Under this arrangement, the meter 52 provides data during the interpulse intervals, the loop 88 provides data continuously during pulsing intervals and interpulse intervals, and both of the branches, namely the positive branch and the negative branch, provide information as to the flame status during the pulsing intervals. The construction and operation of the positive and negative branches of the circuit 26 will now be described.

The positive branch of the circuit 26 comprises a comparator 90, a gate 92, a counter 94, and a source 96 of a reference signal. Similarly, the negative branch comprises a comparator 98, a gate 100, a counter 102, and a source 104 of reference signal. Output signals of the counters 94 and 102 are connected by a selector switch 106 to an input port 108 of the microprocessor 60. The comparator 90 receives at its input terminals an output signal of the limiter 80 and a reference signal from the source 96, the comparator 90 comparing the two signals to output a logic signal, having a value of 0 or 1, to an input terminal of the gate 92.

Similarly, the comparator 98 receives at its input terminals the output signal of the limiter 80 and a reference signal from the source 104, the comparator 98 comparing the limiter signal with the reference signal and outputting a logic signal, having a value of 0 or 1, resulting from the comparison to an input terminal of the gate 100. The gates 92 and 100 are activated concurrently during a measurement interval by an output 110 of the microprocessor 60. Pulse signals conducted via the gates 92 and 100 are counted respectively by the counters 94 and 102. The counters 94 and 102 are reset simultaneously by an output 112 of the microprocessor 60.

During operation, and with reference to FIGS. 2 and 3, the pulse signals of the first two graphs of FIG. 3 are amplified and limited by the limiter 80 to convert the spike-shaped waveforms to substantially rectangular waveforms of uniform amplitude, which are more readily processed by the comparators 90 and 98 than the spike-shaped waveforms. The limiter 80 operates symmetrically with respect to positive and negative values of voltage to preserve the polarity of the pulses depicted in the first two graphs of FIG. 3.

The reference signal of the source 96 has a positive value, and the reference signal of the source 104 has a negative value. The comparator 90 is activated to produce a logic-1 signal in response to the presence of positive pulses exceeding the reference signal of the source 96. Similarly, the comparator 98 is activated to output a logic-1 signal in response to negative pulses which are more negative than the negative value of the reference signal of the source 104. In this manner, the comparator 90 signals the presence of each positive pulse at terminal A, and the comparator 98 signals the presence of each negative pulse at terminal A.

For conditions wherein the flame 18 is absent, the positive and negative pulses are equally likely to occur, and the comparators 90 and 98 output a substantially equal number of logic-1 signals during a measurement interval. For conditions wherein the flame 18 is present, many of the positive pulses fail to appear, as shown in the second graph of FIG. 3 and the comparator 98 outputs more logic-1 signals than does the comparator 90 in the measurement interval. The signals outputted by the comparator 90 of the negative branch during the presence of the flame 18 are shown in the fourth graph of FIG. 3.

The microprocessor 60 establishes the duration of a measurement interval, which is preferably an integral number of cycles of the AC voltage outputted by the supply 68. The switch 72 is closed to provide the ignition and monitoring functions of the circuit 26, an opening of the switch 72 terminating these functions. Assuming that the ignition interval is one second, this encompassing a total of 60 cycles of the AC voltage at a frequency of 60 Hz, a suitable measurement interval would be 40 cycles, for example, from the eleventh cycle to the fiftieth cycle inclusive.

The microprocessor 60 provides an enable signal at the output 110 during the measurement interval to place the gates 92 and 100 in a state of conduction during the measurement interval, and to place the gates 92 and 100 in a state of nonconduction outside of the measurement interval. The counters 94 and 102 count the positive and negative pulses, respectively, and retain their output counts at the end of the measurement interval. The counts are retained until the counters 94 and 102 are later reset by a reset signal at the output 112 of the microprocessor 60.

An output 114 of the microprocessor 60 operates the switch 106 to allow the microprocessor 60 to selectively read the final counts of the counters 94 and 102 prior to the resetting of the counters 94 and 102. The microprocessor 60 compares the counts of the counters 94 and 102 to determine if the flame 18 is present or absent, and to illuminate the lamps 62 and 64 to indicate the presence and absence of flame.

Figure 4:
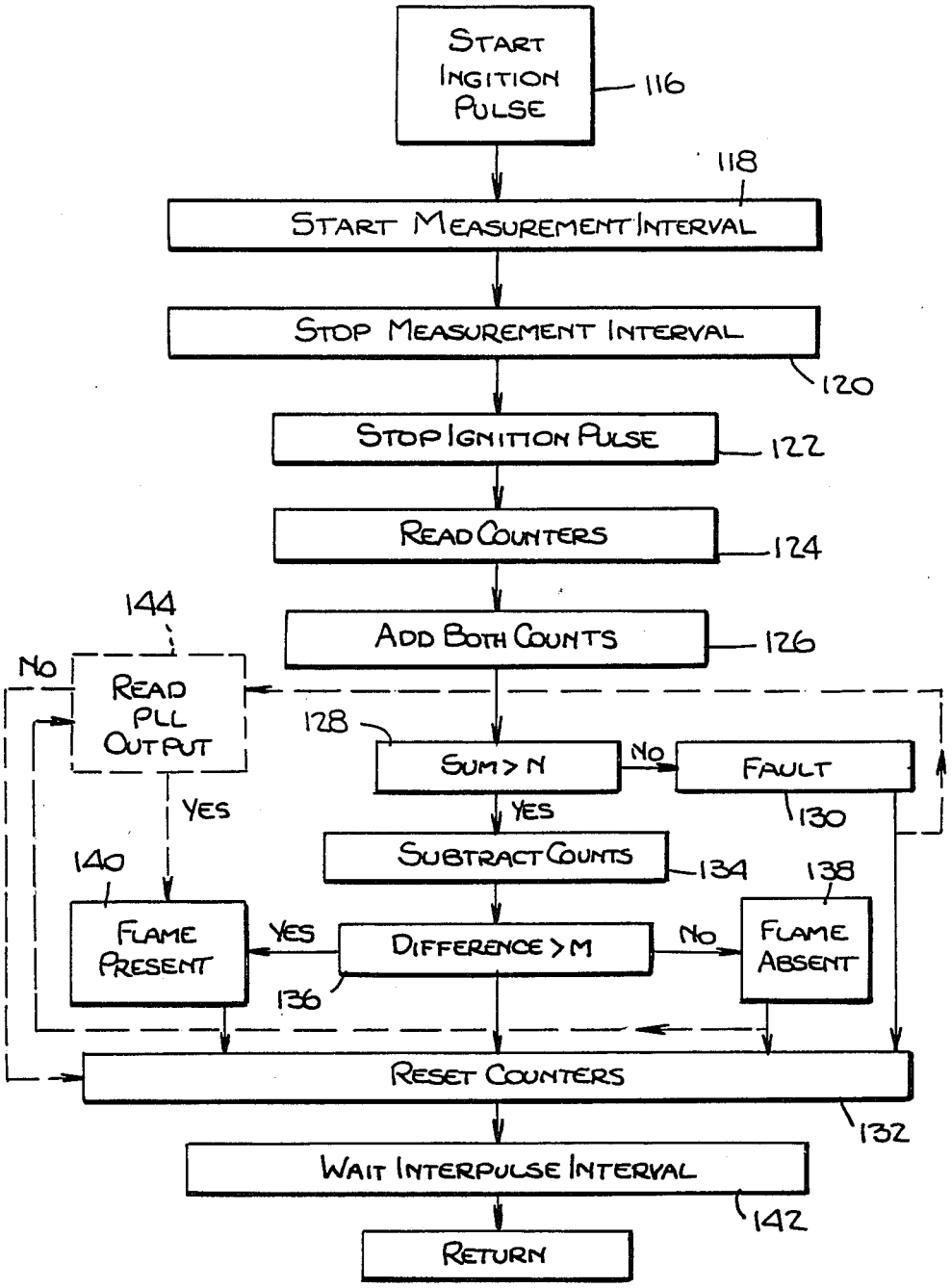
FIG. 4 is a flow chart of the operation of a microprocessor of FIG. 2.

The operation of the microprocessor 60 is schematically shown in the flow chart of FIG. 4. As indicated at the function block 116, the microprocessor 60 activates the output 74 (FIG. 2) to send an electrical ignition current pulse via the transformer 42 to the igniter 16. The flame 18, if present, continues to burn during the ignition pulse. The ignition pulse also provides an opportunity for monitoring the presence of the flame 18. In the event that the flame 18 has been extinguished, as by a strong wind at the top of the stack 14 (FIG. 1), the ignition current is effective to reignite the flame 18.

In a succeeding stage of operation of the microprocessor 60, represented by the function block 118, the measurement interval is started by the enable signal at the output 110. The gates 92 and 100 conduct pulses from the comparators 90 and 98 to the counters 94 and 102, respectively, to develop their respective counts during the measurement interval. The enable signal at the output 110 is terminated, as represented by the function block 120, to stop the measurement interval. Thereafter, the ignition current pulse is terminated, as represented by the function block 122, by terminating the signal at the microprocessor output 74.

The microprocessor 60 can now analyze the data. First, as generally represented by the function block 124, the counts of the counters 94 and 102 are read via the computer port 108. The microprocessor 60 determines whether the monitoring system is functioning properly by adding both of the counts, as represented by the function block 126, to ascertain, as represented by the function block 128, that some counts are present. For example, if it is presumed that there should be at least one pulse per measurement cycle, then the sum of the counts should be greater than N where N is equal to 40. If the sum is less than N, then the computer illuminates the fault lamp 66, as represented by the function block 130, and the program advances to the function represented by the block 132 for a resetting of the counters 94 and 102 prior to commencement of the next measurement interval.

If, at the function represented by the block 128, proper operation of the monitoring circuitry is noted, the program will proceed to the function represented by the block 134 wherein the counts are subtracted to provide a difference in the counts, which difference is examined as represented at the function block 136. If the count difference is approximately zero, then the flame is understood to be absent, and the lamp 64 is lit as represented by the function block 138.

After the lamp 64 is lit, the program proceeds to the function represented by the block 132 for resetting of the counters 94 and 102. At the function represented by the block 136, if a significant difference between the counts is noted, then the flame is understood to be present, and the lamp 62 is lit as represented by the function block 140, after which the program proceeds to the function represented by the block 132 for the resetting of the counters.

At the function represented by the block 136, the count difference is compared to a significant number of pulses, such as 5 or 10 pulses to obviate the possible effect of noise induced pulses in the determination of substantial equality of the counts. Accordingly, the count difference is compared to M where M has a value of, for example, 5 or 10. After the resetting of the counters as represented by the function block 132, the microprocessor 60 then waits, as represented by the function block 142, for the balance of the interpulse interval, approximately 9 seconds, at which point the program returns to the function represented by the block 116 to activate the next ignition pulse.

If it is desired to implement the phased locked loop 88, the loop 88 may be provided with a separate output indicator (not shown) or, alternatively may be employed with the logic of the microprocessor 60 as shown in phantom in FIG. 4. Beginning at the function represented by the block 130 for the lighting of the fault lamp 66, the program proceeds to the function represented by the block 144 in which the microprocessor 60 reads the output signal of the phased locked loop 88 to determine if the output signal is present. If no output signal is present, then the phased locked loop 88 has not sensed the presence of the flame 18, and the program advances to the function represented by the block 132 for resetting the counters.

In the event that the phased locked loop 88 outputs a signal indicating that the flame 18 is present, the program advances to the function represented by the block 140 for lighting the lamp 62, after which the program advances to the function represented by the block 132 for resetting the counters. In this instance, both the lamps 62 and 66 are illuminated to indicate that a fault is present in the monitoring circuitry and that, nevertheless, the phased locked loop 88 has sensed the presence of the flame 18. In this manner, the phase locked loop 88 acts as a backup indicator, together with the backup indication of the meter 52 to show that a flame is present even though the pulses of FIG. 3 have not been found.

The phased locked loop 88 is also encountered at the function represented by the block 138 wherein, after lighting the lamp 64 to indicate the absence of the flame, the program proceeds to the function represented by the block 144 for reading the output signal of the loop 88. Here too, if no output signal is found, then the program advances to function represented by the block 132 for resetting the counters.

If a signal is outputted by the phased locked loop 88 to indicate the detection of a flame 18, then the program advances to the function represented by the block 140 for lighting the lamp 62, after which the program advances to the function represented by the block 132 for resetting the counters. In this instance, both the lamp 64, indicating the absence of a flame, and the lamp 62 indicating the presence of a flame are lit. This shows that, due to a partial failure in the operation of the monitoring circuitry, an equality of the pulses of FIG. 3 has been detected (first graph of FIG. 3) indicating flame absence while the phased locked loop 88 has detected flame presence. In this instance, it is advisable to check the meter 52 as a further backup to determine if the flame is present.

Some advantages of the present invention evident from the foregoing description include a monitoring system employing two or three distinct means for monitoring the flame, thereby enhancing the reliability of the monitoring system. The use of relatively low frequency current excitation, rather than conventional high frequency current excitation, and the use of higher ignition voltage, results in reduced losses associated with capacitance of the ignition cable, and higher voltage and power availability at the electrode assembly 30 for reliable ignition of the flare.

The present ignition system has been found to provide reliable ignition of a flare at distances in excess of 1000 feet between the ignition unit 24 (FIG. 1) and the igniter 16. Thus, the circuit 26 of the ignition unit 24 can be readily serviced at easily accessible locations. A further advantage of the invention is the use of a single cable, namely the ignition cable 22, to provide both ignition and monitoring functions.

A still further advantage of the invention is that the periodic pulsing of the ignition current operates to clean the electrode surfaces of the assembly 30 of oxidation and containments in addition to reignition of a flame that might be blown out. Systems that do not have periodic pulsing capability can accummulate contaminants such as grime and bird droppings which may short out the ignition electrodes or induce undesirable chemical changes of the electrode structure.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. A flame ignition and monitoring system comprising:

an electrode assembly positioned at a fuel passage for directing electric current into the passage for ignition and monitoring of a burning of fuel;

current generating means connected to said electrode assembly for generating said current, said generating means including a transformer for outputting alternating current at a frequency less than approximately 400 Hz and a high voltage in excess of approximately 4000 volts, said transformer outputting a monitoring signal proportional to said current; and signal processing means connected to said transformer for processing said monitoring signal to determine the presence of a flame at said passage, said processing means including means for sensing a harmonic component of said monitoring signal to determine presence of a flame.

2. A system according to claim 1 wherein the frequency of said alternating current is in a range of approximately 40 to 400 Hz, and said voltage is in a range of approximately 4 to 20 kilovolts.

3. A system according to claim 2 wherein said electrode assembly is spaced apart from said current generating means by a distance in excess of 100 feet.

4. A system according to claim 3 further comprising an ignition cable interconnecting said electrode assembly and said generating means.

5. A system according to claim 1 wherein said sensing means of said processing means is operative during a positive half-cycle of said current and during a negative half-cycle of said current to provide a positive measure and a negative measure of signal pulses of said harmonic content, respectively, during said positive and said negative half-cycles, said processing means including means for comparing said positive and said negative measures to determine the presence of a flame.

6. A system according to claim 5 wherein said generating means includes a gating circuit, and said transformer has input terminals connected to said gating circuit, said gating circuit activating said transformer to provide pulses of said high voltage.

7. A system according to claim 6 wherein said processing means includes means for synchronizing said gating means to said sensing means, said sensing means being operative during a sensing interval of time occurring within a duration of said pulses of said high voltage.

8. A system according to claim 7 wherein said gating means includes means for activating said transformer with a low voltage having a value less than approximately 10 per cent of said high voltage during an interpulse interval occurring between successive ones of said high voltage pulses, said system further comprising means for monitoring a plasma current resulting from interaction of a flame with current outputted by said transformer in response to said low voltage.

9. A system according to claim 5 wherein said sensing means includes a pair of comparators operative with dual reference levels for signalling the presence of pulses of said harmonic content during said positive and said negative half-cycles, said sensing means comprising further means for counting signals outputted by said comparators to provide counts designating said positive measures and said negative measure, said system further comprising means for subtracting the counts of said positive measure and said negative measure to determine the presence of a flame.

10. A system according to claim 9 further comprising logic means for comparing counts of said counting means to determine the presence of a fault in said sensing means.

11. A system according to claim 5 wherein said sensing means includes a phase locked loop for extracting a frequency component of said harmonic component, which frequency component designates the presence of a flame.

12. A system according to claim 11 wherein said sensing means includes a pair of comparators operative with dual reference levels for signalling the presence of pulses of said harmonic content during said positive and said negative half-cycles, said sensing means comprising further means for counting signals outputted by said comparators to provide counts designating said positive measure and said negative measure, said system further comprising means for subtracting the counts of said positive measure and said negative measure to determine the presence of a flame; and wherein said system further comprises means for combining an output signal of said phase locked loop to verify the presence of a flame.

13. A method of flame ignition and monitoring comprising:

providing a fuel passage for transporting fuel to a flame, the flame being ignitable at an end of the passage for burning the fuel;

positioning an electrode assembly at the fuel passage, and directing electric current via the electrode assembly into the passage for ignition and monitoring of a burning of fuel;

generating said current by means of a transformer for outputting alternating current at a frequency less than approximately 400 Hz and a high voltage in excess of approximately 4000 volts, said transformer outputting a monitoring signal proportional to said current; and sensing a harmonic component of said monitoring signal to determine presence of a flame.

14. A method according to claim 13 wherein the frequency of said alternating current is in a range of approximately 40 to 400 Hz, and said voltage is in a range of approximately 4 to 20 kilovolts.

15. A method according to claim 14 wherein said step of positioning said electrode assembly provides for a spacing of said electrode assembly from said transformer by a distance in excess of 100 feet.

16. A method according to claim 15 wherein said step of generating includes a step of interconnecting said electrode assembly and said transformer by an ignition cable.

17. A method according to claim 13 wherein said sensing step is operative during a positive half-cycle of said current and during a negative half-cycle of said current to provide a positive measure and a negative measure of signal pulses of said harmonic content, respectively, during said positive and said negative half-cycles, said method including a step of comparing said positive and said negative measures to determine the presence of a flame.

18. A method according to claim 17 wherein said step of generating includes a step of forming a succession of high voltage pulses, and a step of activating said transformer with a low voltage having a value less than approximately 10 percent of said high voltage during an interpulse interval occurring between successive ones of said high voltage pulses; said method including a step of monitoring a plasma current resulting from interaction of a flame with current outputted by said transformer in response to said low voltage.

19. A method according to claim 18 wherein said comparing step includes a counting of pulses of said harmonic content during said positive and said negative half-cycles to provide counts designating said positive measures and said negative measures, said comparing further comprising a subtracting of the counts of said positive measure and said negative measure to determine the presence of a flame.

20. A method according to claim 19 wherein said sensing includes extracting a frequency component of said harmonic component, which frequency component designates the presence of a flame.

* * * * *

UNITED STATES PATENT AND TRADEMARK OFFICE

CERTIFICATE OF CORRECTION

PATENT NO. : 4,871,307

DATED : October 3, 1989

INVENTOR(S) : George W. Harris et al.

It is certified that error appears in the above-identified patent and that said Letters Patent is hereby corrected as shown below: On the title page;

[76] Inventors: Add the following co-inventor:

Art Neel, 1204 Washington Place East, Marshall, Tex. 75670.

At column 2, line 35, change "though" to --through--.

At column 11, line 48, change "containments" to --contaminants--.

At column 12, line 30, change "content" to --component--.

At column 12, line 57, change "content" to --component--.

At column 13, line 9, change "content" to --component--.

At column 14, line 13, change "content" to --component--.

At column 14, line 30, change "content" to --component--.

Signed and Sealed this

Eleventh Day of September, 1990

*Attest:*

HARRY F. MANBECK, JR.

*Attesting Officer*

*Commissioner of Patents and Trademarks*